US006918784B2

(12) United States Patent
Brandl et al.

(10) Patent No.: US 6,918,784 B2
(45) Date of Patent: Jul. 19, 2005

(54) INSULATION DISPLACEMENT CONNECTOR DEVICE WITH DISPLACEABLE CLOSING ELEMENT

(75) Inventors: Wolfgang Brandl, Amberg (DE); Peter Donhauser, Amberg (DE); Alfred Fischer, Schwandorf (DE); Ludwig Niebler, Laaber (DE)

(73) Assignee: Siemens Aktiengesellschaft, Munich (DE)

( * ) Notice: Subject to any disclaimer, the term of this patent is extended or adjusted under 35 U.S.C. 154(b) by 136 days.

(21) Appl. No.: 10/343,004

(22) PCT Filed: Jul. 16, 2001

(86) PCT No.: PCT/DE01/02655

§ 371 (c)(1),
(2), (4) Date: Jan. 27, 2003

(87) PCT Pub. No.: WO02/11243

PCT Pub. Date: Feb. 7, 2002

(65) Prior Publication Data

US 2004/0253865 A1 Dec. 16, 2004

(51) Int. Cl.[7] ..... H01R 4/24
(52) U.S. Cl. ..... 439/395; 439/417
(58) Field of Search ..... 439/395, 409, 439/410, 417, 713, 715, 716

(56) References Cited

U.S. PATENT DOCUMENTS 5,816,843 A 10/1998 Gerberding ..... 439/410
6,065,996 A 5/2000 Bechaz et al. ..... 439/409
6,120,315 A 9/2000 Gaertner et al. ..... 439/395
6,146,186 A * 11/2000 Barrat et al. ..... 439/410
6,159,035 A * 12/2000 Smith, III ..... 439/391
6,254,421 B1 * 7/2001 Denovich et al. ..... 439/409

FOREIGN PATENT DOCUMENTS

| | | |
|---|---|---|
| DE | 3300697 | 8/1983 |
| DE | 19541137 | 5/1997 |
| DE | 29802674 | 5/1998 |
| EP | 0984513 A | 3/2000 |
| EP | 1120859 | 8/2001 |
| FR | 2516711 A | 5/1983 |
| GB | 2114824 A | 8/1983 |

* cited by examiner

*Primary Examiner*—Hien Vu
(74) *Attorney, Agent, or Firm*—Harness, Dickey & Pierce, P.L.C.

(57) ABSTRACT

An insulation displacement connector device includes a base body, with a cutting clamp mounted on the base body and a closing element which may be displaced relative to the base body. The base body including an operating volume into which an operating tool may be introduced. The operating tool may be pivoted in a pivoting direction within the operating volume. The closing element may thus be moved between an open and a closed position. The closing element defines the operating volume on one side viewed from the pivoting direction.

10 Claims, 2 Drawing Sheets

INSULATION DISPLACEMENT CONNECTOR DEVICE WITH DISPLACEABLE CLOSING ELEMENT

This application is the national phase under 35 U.S.C. § 371 of PCT International Application No. PCT/DE01/02655 which has an International filing date of Jul. 16, 2001, which designated the United States of America and which claims priority on German Patent Application number DE 100 36 718.6 filed Jul. 27, 2000, the entire contents of which are hereby incorporated herein by reference.

FIELD OF THE INVENTION

The present invention generally relates to an insulation displacement connector device with a basic body with an insulation displacement connector held by the basic body and with a closing element which may be moved with respect to the basic body, the basic body having an operational volume into which an operating tool can be introduced, the operating tool being pivotable in a pivoting direction within the operational volume, the closing element being moveable between an opening and a closing position by virtue of the pivoting of the operating tool.

BACKGROUND OF THE INVENTION

An insulation displacement connector device is disclosed in the brochure "Product information IDC—Insulation Displacement Connection" from the company Weidmüller.

Insulation displacement connector devices have a relatively large volume requirement in comparison with conventional screw-type terminals. Therefore, it is generally endeavored to reduce the necessary volume requirement as far as possible.

In the case of the insulation displacement connector device in accordance with prior art devices, a closing element projects beyond an apparatus contour in the open state. The travel path of the closing element is thus outside the apparatus contour.

GB A 2 114 824 discloses an insulation displacement connector device with a basic body with an insulation displacement connector held by the basic body and with a closing element which can be moved with respect to the basic body. In the case of this insulation displacement connector device, the basic body has an operational volume into which an operating tool may be introduced. The operating tool is pivotable in a pivoting direction within the operational volume, so that the closing element can be moved from the opening to the closing position by the pivoting of the operating tool. The closing element bounds the operational volume on one side viewed in the pivoting direction. The operational volume has a bearing groove which forms a pivot bearing for the operating tool introduced into the operational volume. The closing element has a main body onto which an introduction contour is integrally formed on its side facing the operational volume.

SUMMARY OF THE INVENTION

An embodiment of the present invention provides an insulation displacement connector device which has a relatively small volume requirement.

An embodiment of the present invention provides an insulation displacement connector device having the features of claim 1.

If the introduction contour is of flexible design, space utilization may be generally improved.

In particular, space utilization may be improved if the main body, at least below the introduction contour, runs essentially parallel to the opposite wall of the operational volume.

An embodiment of the present invention provides an arrangement which has at least three insulation displacement connector devices. The devices are arranged one behind the other viewed in the pivoting direction. This is because, at least in the case of the middle one of these insulation displacement connector devices, an alternative solution, e.g. in the form of the closing element traveling out of the apparatus contour, may not be possible in principle due to a construction thereof.

Further scope of applicability of the present invention will become apparent from the detailed description given hereinafter. However, it should be understood that the detailed description and specific examples, while indicating embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
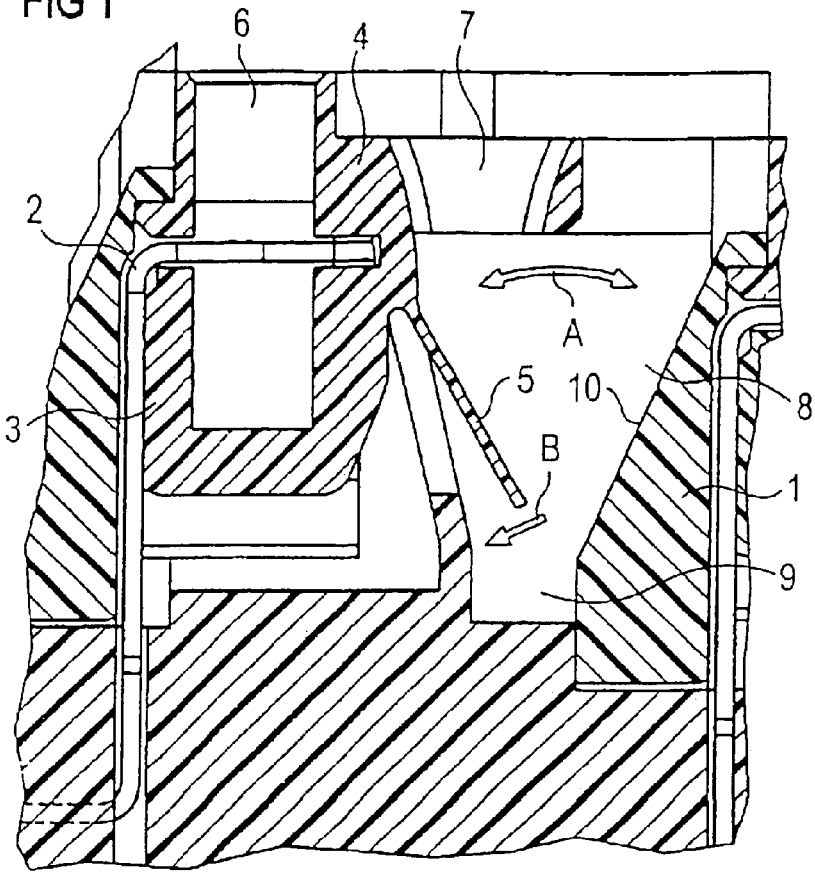
FIG. 1 illustrates a cross-sectional view of an insulation displacement connector device according to an embodiment of the present invention.

In accordance with FIG. 1, an insulation displacement connector device a basic body 1. The basic body 1 is illustrated only partially in FIG. 1. An insulation displacement connector 2 is held by the basic body 1. The insulation displacement connector device furthermore has a closing element 3. The latter is moveable with respect to the basic body 1—in a manner held and guided by the basic body 1. The closing element 3 comprises a main body 4 and an introduction contour 5 integrally formed onto the main body 4. The introduction contour is designed as an introduction tab 5 in accordance with an exemplary embodiment of the present invention.

The closing element 3 may be moved between a closing position and an opening position. The closing position is illustrated in FIG. 1. In this position, a single-core electrical conductor (not illustrated) introduced into a conductor guide 6 is clamped and held by the insulation displacement connector 2. In order to be transferred into the opening position, the closing element 3 may be displaced toward the right in FIG. 1. In this position, the conductor may be introduced into the conductor guide 6 or be withdrawn from the latter.

In order to move the closing element 3, an operating tool (not illustrated in the Figures), such as a screwdriver or the like, may introduced into an operational volume 8 through a cutout 7 of the closing element 3. The operational volume 8 is essentially formed by the basic body 1. One side of the operational volume 8 is bounded by the closing element 3.

The tip of the operating tool may be directed in the direction of a bearing groove 9 by the introduction tab 5. The introduction tab 5 thus serves for guiding the operating tool. The bearing groove 9 forms a pivot bearing for the operating tool introduced into the operational volume 8. Consequently, by pivoting the operating tool in a pivoting direction A within the operational volume 8, the closing element 3 is transferred from the opening to the closing position or, vice versa, from the closing position to the opening position.

In the opening position, the introduction tab 5 abuts a wall 10 of the basic body 1 opposite the closing element 3. For better space utilization, the introduction tab 5, which is integrally formed on that side of the main body 4 which faces the operational volume, is therefore of flexible design. In this case, the flexibility of the introduction tab 5 may result from the way in which it is integrally formed and/or intrinsically from a pliability of the introduction tab 5. The flexibility of the introduction tab 5 is indicated by a bending arrow B in FIG. 1.

In accordance with an exemplary embodiment of the present invention, the main body 4, below the introduction tab 5, runs essentially parallel to the opposite wall 10 of the operational volume 8. The space utilization is further improved as a result.

Figure 2:
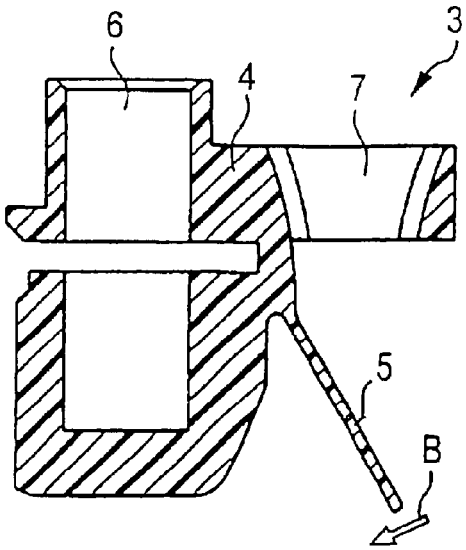
FIG. 2 illustrates a cross-sectional view a closing element in section according to an embodiment of the present invention.
Figure 3:
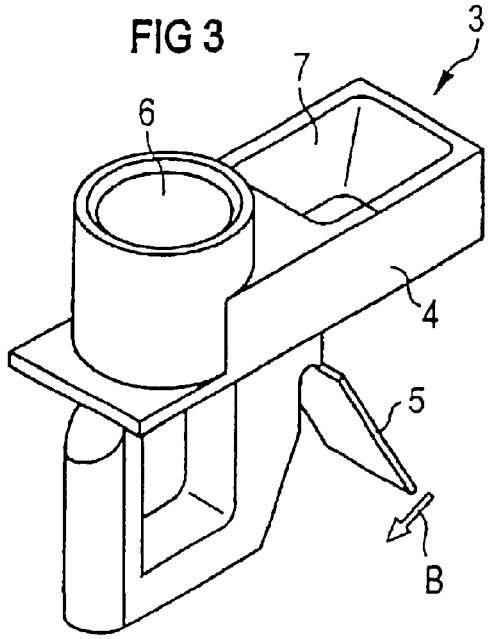
FIG. 3 shows a perspective illustration of the closing element from FIG. 2.

FIGS. 2 and 3 illustrate the closing element 3. In FIGS. 2 and 3, identical elements are provided with the same reference symbols as in FIG. 1.

As an alternative to the illustrated embodiment with an introduction tab 5, the latter may be obviated. In this case a user is responsible, by introducing the operating tool into the operational volume 8 in a suitable manner, for ensuring that the tip of the operating tool enters into the bearing groove 9. In the case of the embodiment illustrated in FIG. 1, by contrast, this is inevitably ensured by the guide tab 5. If an embodiment without an introduction tab 5 is chosen, it should furthermore be the case that, in order to improve the space utilization, the closing element 3, at least in the lower region, as in accordance with the embodiment of the main body 4 of the closing element 3 illustrated in FIGS. 1 to 3, runs essentially parallel to the opposite wall 10 of the operational volume 8.

The insulation displacement connector device according to the embodiments of the present invention results in a reduced structural volume which is only slightly in excess of that of comparable screw-type terminals. This is advantageous in the case of an arrangement of the type illustrated in FIG. 4. In accordance with FIG. 4, a plurality of insulation displacement connector devices—four in the present case—according to an embodiment of the present invention are arranged one behind the other viewed in the pivoting direction. In the case of the right-hand one of the insulation displacement connector devices, the closing element 3 is in this case depicted both in the closing position and in the opening position.

Figure 4:
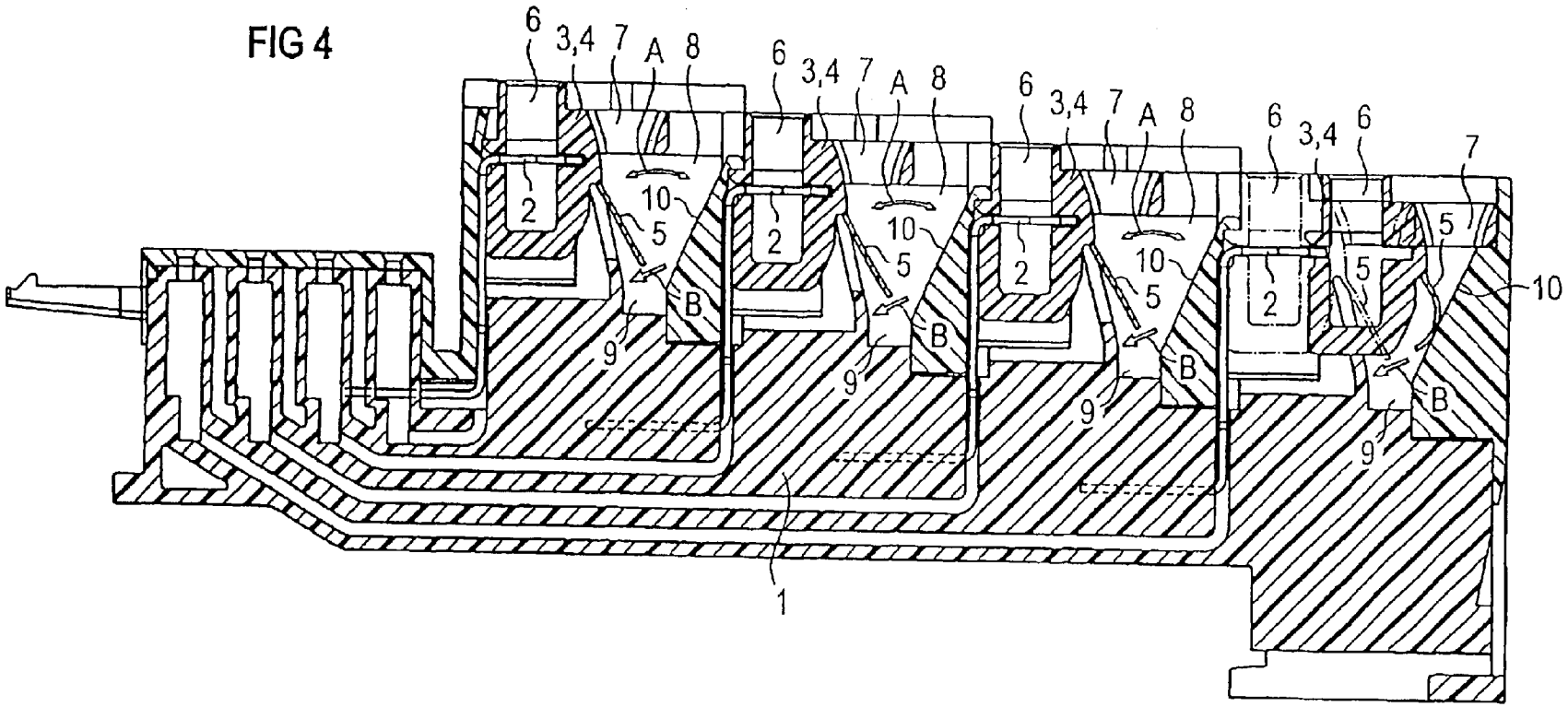
FIG. 4 illustrates an arrangement with a plurality of insulation displacement connector devices according to an embodiment of the present invention.

An arrangement in accordance with FIG. 4 is required, e.g. in multistage series terminals or jumper distributors. An arrangement of this type can also be used expediently in the case of electrical apparatuses to which a multiplicity of conductors are to be connected. Examples of such electrical apparatuses are peripheral assemblies of stored-program controllers, contactors, power circuit-breakers or relays.

Exemplary embodiment of the present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An insulation displacement connector device, comprising:

a basic body having an insulation displacement connector held by the basic body and a closing element movable with respect to the basic body, the basic body having an operational volume; and an operating tool being insertable within the operational volume, the operating tool being pivotable in a pivoting direction within the operational volume;

wherein the closing element is moveable between an opening and a closing position by virtue of the pivoting operating tool, the closing element bounding the operational volume on one side viewed in the pivoting direction, the operational volume having a bearing groove that forms a pivot bearing for the operating tool introduced into the operational volume, and the closing element having a main body onto which a tab extended towards the bearing groove for guiding the operating tool is integrally formed on the side thereof facing the operational volume, by way of which the operating tool is guidable into the bearing groove both in the open position and in the closed position of the closing element.

2. The insulation displacement connector device as claimed in claim 1, wherein the tab is flexible.

3. The insulation displacement connector device as claimed in claim 2, wherein the main body, has a wall portion below the tab that, runs substantially parallel to a wall of the operational volume.

4. An arrangement, comprising:

at least three insulation displacement connector devices as claimed in claim 2, the at least three insulation displacement connector devices being arranged one behind the other as viewed in a pivoting direction.

5. An arrangement, comprising:

at least three insulation displacement connector devices as claimed in claim 3, the at least three insulation displacement connector devices being arranged one behind the other as viewed in a pivoting direction.

6. An arrangement, comprising:

at least three insulation displacement connector devices as claimed in claim 1, the at least three insulation displacement connector devices being arranged one behind the other as viewed in a pivoting direction.

7. An insulation connector device, comprising:

an insulation displacement connector being attached to a main body of a closing element, the closing element having a tab integrally formed on one side thereof and extended toward a bearing groove for facilitating movement of the closing element, and for guiding an operating tool into the bearing groove;

wherein the insulation displacement connector is held by a basic body having the bearing groove.

8. The insulation connector device according to claim 7, wherein the tab is flexible.

9. A closing element for an insulation displacement connector device, comprising:

a main body; and an introduction tab formed integrally to the body and extended toward a bearing groove, for guiding an operating tool into the bearing groove;

wherein a through cutout for receiving the operating tool is formed in the main body; and wherein the through cutout is positioned above the introduction tab.

10. The closing element according to claim 9, wherein the introduction tab is flexible.

* * * * *